United States Patent [19]

Ealding et al.

[11] 4,329,423

[45] May 11, 1982

[54] PHOTOGRAPHIC COATED FILM BASES

[75] Inventors: Cyril J. Ealding, Chester, Va.; Graham Jarrett, Hitchin, England

[73] Assignee: Imperial Chemical Industries Limited, London, England

[21] Appl. No.: 199,567

[22] Filed: Oct. 22, 1980

Related U.S. Application Data

[63] Continuation of Ser. No. 953,213, Oct. 20, 1978, abandoned.

[30] Foreign Application Priority Data

Oct. 3, 1977 [GB] United Kingdom ..... 40970/77
Sep. 18, 1978 [GB] United Kingdom ..... 37192/78

[51] Int. Cl.[3] ..... G03C 1/78

[52] U.S. Cl. ..... 430/534; 430/533; 430/536; 430/535; 430/935

[58] Field of Search ..... 430/533, 536, 635, 935, 430/302, 535, 534

[56] References Cited

U.S. PATENT DOCUMENTS

| | | | |
|---|---|---|---|
| 3,145,105 | 8/1964 | Lee | 430/533 |
| 3,353,958 | 11/1967 | Moede | 430/535 |
| 3,443,950 | 5/1969 | Rawlins | 430/535 |
| 3,460,945 | 8/1969 | Kolesinski et al. | 430/534 |
| 3,545,972 | 12/1970 | D'Cruz | 430/535 |
| 3,567,452 | 3/1971 | Rawlins | 430/535 |
| 3,600,166 | 8/1971 | Sieg et al. | 430/302 |
| 3,615,444 | 10/1971 | Ohkubo et al. | 430/302 |
| 4,039,333 | 8/1977 | Shinagawa et al. | 430/422 |

FOREIGN PATENT DOCUMENTS

| | | |
|---|---|---|
| 856322 | 11/1970 | Canada . |
| 1001716 | 8/1965 | United Kingdom . |
| 1146215 | 3/1969 | United Kingdom . |
| 1151843 | 5/1969 | United Kingdom . |
| 1468964 | 3/1977 | United Kingdom . |
| 1509791 | 5/1978 | United Kingdom . |

*Primary Examiner*—Jack P. Brammer
*Attorney, Agent, or Firm*—Cushman, Darby & Cushman

[57] ABSTRACT

Improvements in coated film bases. Photobase comprising a film support, e.g. a polyethylene terephthalate film, having a copolymeric subbing layer comprising a copolymer of acrylic acid or an alkyl ester thereof/methacrylic acid or an alkyl ester thereof/itaconic acid or itaconic anhydride, e.g. an ethyl acrylate/methyl methacrylate/itaconic acid copolymer, and containing free itaconic acid, half ester or anhydride which is directly adherent to light-sensitive photographic emulsions.

17 Claims, No Drawings

PHOTOGRAPHIC COATED FILM BASES

This is a continuation, of application Ser. No. 953,213, filed Oct. 20, 1978, now abandoned.

The present invention relates to light-sensitive photographic films and to processes for their production.

The adhesion of light-sensitive photographic emulsions applied directly to the surface of a plastics support film is generally inadequate to withstand the conditions of handling and treatment to which photographic films are subjected. In order to provide acceptable adhesion it has become common practice in the photographic art to interpose two or more subbing layers between the support film and the light-sensitive photographic emulsion. The subbing layers of typical conventional photographic films generally comprise, outwardly from the support film, a copolymeric subbing layer and a gelatinous subbing layer, a light-sensitive photographic emulsion such as a gelatinous emulsion containing a light-sensitive silver halide being adhered to the gelatinous subbing layer.

Whilst the benefits, such as simplification of the coating process, which would result from the elimination of one or more of the subbing layers have been recognised in the art, Applicants are not aware of any proposals which have resulted in successful commercial exploitation.

Applicants have now discovered that photographic emulsions adhere directly to a specific class of subbing copolymers without the interposition of a gelatinous subbing layer.

According to the present invention a light-sensitive photographic film comprises a self-supporting plastics film, a copolymeric subbing layer applied to at least one surface of said film and a light-sensitive photographic emulsion layer bonded directly to the copolymeric subbing layer, said copolymeric subbing layer comprising a copolymer prepared from a comonomer mixture comprising 35 to 55 mole % acrylic acid or a lower alkyl ester thereof in which the alkyl group comprises up to 8 carbon atoms, 35 to 55 mole % methacrylic acid or a lower alkyl ester thereof in which the alkyl group comprises up to 8 carbon atoms, and 1 to 15 mole % of itaconic acid, a half ester of itaconic acid or itaconic anhydride, and said copolymeric subbing layer having a dry coat weight in the range 0.05 to 3.00 mg/dm$^2$.

Also according to the present invention, a process for the production of a light-sensitive photographic film comprises coating at least one surface of a self-supporting plastics film with a subbing composition comprising an aqueous dispersion or a solution in an organic solvent of a copolymer prepared from a comonomer mixture comprising 35 to 55 mole % acrylic acid or a lower alkyl ester thereof in which the alkyl group comprises up to 8 carbon atoms, 35 to 55 mole % methacrylic acid or a lower alkyl ester thereof in which the alkyl group comprises up to 8 carbon atoms, and 1 to 15 mole % of itaconic acid, a half ester of itaconic acid or itaconic anhydride, and causing or allowing the coating to dry to a coat weight in the range 0.05 to 3.00 mg/dm$^2$, and applying a layer of a light-sensitive photographic emulsion directly onto the resulting copolymeric subbing layer.

According to this invention, light-sensitive photographic emulsions can be adhered directly to the copolymeric subbing layer, i.e. adequate emulsion adhesion under conventional conditions for handling and treating photographic films is achieved by coating the photographic emulsion layer in face-to-face contact with the copolymeric subbing layer and without the need for an interposed gelatinous subbing layer or any treatment or surface modification of the copolymeric subbing layer, such as corona discharge treatment as described in British patent specification No. 1 259 506.

The self-supporting plastics film may consist of a cellulose ester such as cellulose triacetate or any suitable thermoplastics film, such as films of polysulphones, polystyrene and linear polyesters which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful for the production of the photographic films according to this invention. Such self-supporting thermoplastics films may be transparent and light-transmitting, optionally including photographically inert dyestuffs, e.g. blue dyestuffs for X-ray films, or may be rendered opaque by the addition of additives, such as pigments and fillers, and may in particular have a white and paper-like texture which may be achieved by the addition of suitable fillers and/or by voiding. The white and paper-like films may be used as bases for photographic prints. Films suitable for use in "instant" photography may be pigmented black with carbon black particles.

The lower alkyl esters of acrylic and methacrylic acid as comonomers of the subbing copolymer may comprise the methyl, ethyl, propyl, isopropyl, butyl, pentyl, hexyl, heptyl, n-octyl and 2-ethylhexyl esters, the preferred esters being ethyl acrylate and methyl methacrylate.

Itaconic acid is particularly effective as the third comonomer. Half esters of itaconic acid wherein one carboxylic acid group is esterified are also effective comonomers. It has been found that the use of itaconic acid, a half ester of itaconic acid or itaconic anhydride as comonomers in the subbing copolymer is effective not only in providing the desired adhesive properties of the photographic emulsion applied thereto but also in enhancing the wetting of the plastics film during the application of the subbing composition.

Stronger adhesion of light-sensitive photographic emulsions to the subbing layer is achieved when the subbing copolymer is prepared from a comonomer mixture containing a molar excess of itaconic acid, a half ester of itaconic acid or itaconic anhydride such that free unpolymerised acid, half ester or anhydride is present in the subbing layer. Stronger dry adhesions are obtained with a least 1.0% by weight of free itaconic acid, half ester or itaconic acid, or itaconic anhydride based on the weight of the copolymer.

The subbing copolymer, may if desired, be derived from four or more comonomers, the additional comonomers being employed to modify such properties as dry adhesion and being present in the copolymer in an amount comprising up to 8 mole %. Suitable additional comonomers include acrylamide, methacrylamide, N-methylol acrylamide, N-ethanol acrylamide, N-propanolacrylamide, N-methylol methacrylamide, N-ethanol methacrylamide, N-methyl acrylamide, N-tertiary-butylacrylamide, nitriles, e.g. acrylonitrile, halo-substituted acrylonitrile and methacrylonitrile, and amines, e.g. dimethylaminoethylmethacrylate.

Proportions in the range 35 to 55 mole % of acrylic acid or a lower alkyl ester thereof and 35 to 55 mole % of methacrylic acid or a lower alkyl ester thereof are effective in providing satisfactory adhesions to light-sensitive photographic emulsions; smaller or greater proportions result in weaker adhesion. Optimum adhesions to conventional photographic emulsions are achieved with preferred proportions of acrylic acid or the lower alkyl ester thereof in the range 42 to 50 mole % and of methacrylic acid or the lower alkyl ester thereof in the range 44 to 55 mole %.

Ethyl acrylate and methyl methacrylate are particularly effective comonomers and provide satisfactory subbing properties when both are copolymerised together with itaconic acid. Particularly beneficial subbing properties and especially adhesion to photographic emulsions are achieved with subbing copolymers consisting of 43 to 50 mole % ethyl acrylate, 45 to 53 mole % methyl methacrylate and 4 to 10 mole % of itaconic acid.

The subbing copolymer may be prepared by conventional emulsion polymerisation techniques in water in the presence of a suitable emulsifying agent or a mixture of emulsifying agents. The total amount of emulsifying agent can influence the adhesion of photographic emulsions to the copolymeric subbing layer and it is therefore preferred to employ up to 5% by weight of emulsifying agent based on the total weight of the comonomers and preferably about 4% by weight. Anionic emulsifying agents such as unbranched sodium dodecyl benzene sulphonate, which is available commercially as 'Nansa' 1106 provide particularly good adhesions to photographic emulsions which may if desired be used in admixture with other emulsifying agents.

Conventional additives such as adhesion promoters, slip and anti-static agents may be included in the copolymeric subbing composition in small amounts, e.g. not exceeding 10% by weight based upon the weight of the subbing copolymer, since larger amounts may adversely affect the adhesion of photographic emulsions.

When the self-supporting thermoplastics film is an oriented film, e.g. a biaxially oriented film of polyethylene terephthalate, the subbing composition may be applied to the film before, during or after the stretching process employed to achieve orientation. A convenient procedure is to coat the film between the two stretching operations which are applied in mutually perpendicular directions to orient the film, particularly as this enhances the adhesion between the film and the subbing layer.

The procedure for applying the subbing composition may be any of the known coating techniques, such as dip coating, bead coating, reverse roller coating, air knife, direct gravure or slot coating and the composition may be applied as an aqueous latex or solution or as a solution in an organic solvent.

The pH of the subbing composition should preferably be in the range 2.0 to 5.0 and most preferably 2.5 to 3.0. Whilst coating quality is better with higher pHs, e.g. up to 7, it has been found that a satisfactory combination of adhesion and coating quality is obtained in the range 2.5 to 3.0.

It is preferred that the subbing copolymer should comprise from 2 to 10% by weight and particularly about 5% by weight of the subbing composition since compositions of such concentration dry slowly and provide subbing layers of uniform coating quality having particularly satisfactory adhesions to photographic emulsions.

The dried copolymeric subbing layer has a coat weight in the range 0.05 to 3.00 mg/dm$^2$ and most preferably 0.5 to 1.00 mg/dm$^2$ for optimum adhesion to photographic emulsions. Such coat weights may be accomplished by appropriate modifications to the concentration of the subbing composition and/or the conditions of coating.

The copolymeric subbing layers applied according to this invention to linear polyester films such as polyethylene terephthalate films are such that the film base, i.e. the polyester film carrying the copolymeric subbing layer but not the light-sensitive photographic emulsion, is suitable for recycling through the film-forming extruder and stretching equipment.

Any suitable light-sensitive photographic emulsion, such as a conventional gelatinous silver halide emulsion, may be applied by conventional techniques directly to the subbing layer. Alternative light-sensitive emulsions based upon binding resins other than gelatin, e.g. those binding resins described in U.S. Pat. No. 4,033,772, may also be applied with good adhesion to the subbing copolymer layers of this invention. Such emulsions may contain any of the conventional additives. It has been found that light-sensitive photographic emulsions bond with good adhesion after direct application to the surface modified layer.

Light-sensitive photographic emulsions, such as conventional gelatinous silver halide X-ray and graphic arts emulsions, adhere to the copolymeric subbing layers with good adhesions before and after accelerated ageing by incubation when evaluated by the tests described below.

The tests referred to in this specification were effected as follows:

Dry adhesion refers to the adhesion of a gelatinous silver halide emulsion via the copolymeric subbing layer to the self-supporting thermoplastics film in the final photographic film after incubation at 50° C. and 75% relative humidity for 16 hours, assessed, both before and after processing in standard photographic chemicals, by sticking a self-adhesive tape along the torn edge of the film and rapidly separating the tape from the film. The adhesion of the emulsion was graded in five progressive grades 1 to 5, Grade 1 being when no emulsion was removed after 8 separations of the adhesive tape and Grade 5 being when all the emulsion was removed with one separation of the tape.

Wet adhesion refers to the adhesion of a gelatinous silver halide emulsion via the copolymeric subbing layer to the self-supporting thermoplastics film in the final photographic film, assessed, after processing in the standard photographic chemicals and washing in water for 15 minutes by rubbing with a sponge over a series of lines scored in the still wet emulsion. The adhesion of the emulsion was graded in five progressive grades 1 to 5, Grade 1 being when no emulsion was removed by rubbing 10 times over the scored lines and Grade 5 being when all of the emulsion was removed by rubbing 10 times.

The invention is further illustrated by the following examples.

EXAMPLES 1 to 19

The subbing compositions for each Example were prepared in batches by conventional emulsion polymerisation in water, the comonomers and other polymerisation ingredients and the quantities employed being shown in Tables 1 to 3 together with the amount of unpolymerised acid in % by weight based on the weight of the copolymer and the pH of the latices.

A polyethylene terephthalate film was melt extruded and quenched to the amorphous state on a cooled rotating drum. The resulting film was stretched in the direction of extrusion to about 3.0 times its original length. It was then coated on one side with the aqueous subbing composition described in each of the Examples and passed into a stenter oven where the coating was dried. In each Example the coating composition, which was applied by a roller coating technique, contained about 5% by weight of the subbing copolymer based on the total weight of the composition. The dried coated film was then stretched sideways about 3.0 times its original width and finally heat set at a temperature of about 220° C. The resulting films had an overall thickness of about 100 microns and the dry coat weights of the applied subbing are shown in Tables 1 to 3.

A conventional aqueous gelatinous silver halide emulsion was applied directly to the subbing layers and tested for dry and wet adhesions by the procedures described above, the adhesions also being shown in Tables 1 to 3. The measured adhesions between the emulsion layers and the subbing layers are sufficient to resist the conditions of handling and treatment, including wet processing, to which photographic films are normally subjected.

The subbing layers described in the above Examples provided satisfactory adhesions to other photographic emulsions including modified X-ray emulsions.

TABLE 1

| Example | Comonomers and mole % in polymerisation mixture: Ethyl acrylate | Methyl methacrylate | Itaconic acid | Emulsifying agent and amount - weight % based on total weight of comonomers | Catalyst and amount - weight % based on total weight of comonomers | pH | Amount of free acid in subbing composition - % by weight based on weight of copolymer | Dry coat weight of subbing layer mg/dm$^2$ | Dry adhesion | Wet adhesion |
|---|---|---|---|---|---|---|---|---|---|---|
| 1 | 46.6 | 50.4 | 3.0 | 'Nansa' 1106 1.9 | None | 2.7 | 0.7 | 0.5 | 2 | 1 |
| 2 | 43.2 | 52.1 | 4.7 | 'Nansa' 1106 1.9 | Potassium persulphate 1.0 | 2.7 | 1.0 | 1.0 | 2 | 1 |
| 3 | 46.5 | 48.4 | 5.1 | 'Nansa' 1106 3.8 | Potassium persulphate 1.0 | 2.7 | 1.1 | 1.0 | 3 | 1 |
| 4 | 43.2 | 52.1 | 4.7 | 'Nansa' 1106 3.4 | Potassium persulphate 1.0 | 2.7 | 1.0 | 1.0 | 3 | 1 |
| 5 | 43.2 | 52.1 | 4.7 | 'Nansa' 1106 3.6 | Potassium persulphate 1.0 | 2.7 | 1.0 | 1.0 | 2 | 1 |
| 6 | 49.2 | 45.9 | 4.9 | 'Nansa' 1106 4.8 | Potassium persulphate 1.0 | 2.7 | 1.2 | 0.5 | 3 | 1 |
| 7 | 44.2 | 46.6 | 9.2 | 'Nansa' 1106 3.9 | Potassium persulphate 1.0 | 7.0 | 1.8 | 1.0 | 3 | 1 |
| 8 | 44.2 | 46.6 | 9.2 | 'Nansa' 1106 3.9 | Potassium persulphate 1.0 | 2.5 | 1.8 | 1.1 | 1 | 1 |
| 9 | 45.6 | 45.6 | 8.8 | 'Aerosol' OT 3.2 'Nansa' 1106 0.56 | Potassium persulphate 1.0 | 2.7 | 1.6 | 1.0 | 1 | 1 |
| 10 | 44.8 | 46.6 | 8.6 | 'Aerosol' OT 3.2 'Nansa' 1106 0.5 | Potassium persulphate 1.0 | 2.7 | 1.6 | 1.0 | 2 | 1 |
| 11 | 44.2 | 46.6 | 9.2 | 'Nansa' 1106 3.9 | Potassium persulphate 1.0 | 2.5 | 1.8 | 0.6 | 1 | 1 |

TABLE 2

| Example | Comonomers and mole % in polymerisation mixture | | | Emulsifying agent and amount - weight % based on total weight of comonomers | Catalyst and amount - weight % based on total weight of comonomers | pH | Amount of free acid, itaconate or anhydride in subbing composition - % by weight based on weight of copolymer | Dry coat weight of subbing layer mg/dm$^2$ | Dry adhesion | Wet adhesion |
|---|---|---|---|---|---|---|---|---|---|---|
| 12 | Methyl acrylate | Methyl methacrylate | Itaconic acid | 'Nansa' 1106 1.5 | Potassium persulphate | 2.9 | 1.9 | 0.75 | 1 | 1 |

TABLE 2-continued

| Example | Comonomers and mole % in polymerisation mixture | | | Emulsifying agent and amount - weight % based on total weight of comonomers | Catalyst and amount - weight % based on total weight of comonomers | pH | Amount of free acid, itaconate or anhydride in subbing composition - % by weight based on weight of copolymer | Dry coat weight of subbing layer mg/dm$^2$ | Dry adhesion | Wet adhesion |
|---|---|---|---|---|---|---|---|---|---|---|
| | 44.0 | 47.0 | 9.0 | | 1.0 | | | | | |
| 13 | n-Butyl acrylate | Methyl methacrylate | Itaconic acid | 'Nansa' 1106 1.5 | Potassium persulphate | 2.8 | 4.7 | 0.75 | 1 | 1 |
| | 44.0 | 47.0 | 9.0 | | 1.0 | | | | | |
| 14 | Ethyl acrylate | Ethyl methacrylate | Itaconic acid | 'Nansa' 1106 1.5 | Potassium persulphate | 2.9 | 4.0 | 0.75 | 1 | 1 |
| | 44.0 | 47.0 | 9.0 | | 1.0 | | | | | |
| 15 | Ethyl acrylate | n-Butyl methacrylate | Itaconic acid | 'Nansa' 1106 1.5 | Potassium persulphate | 2.8 | 5.0 | 0.75 | 1 | 1 |
| | 44.0 | 47.0 | 9.0 | | 1.0 | | | | | |
| 16 | Ethyl acrylate | Methyl methacrylate | Monoethyl itaconate | 'Nansa' 1106 1.5 | Potassium persulphate | 2.9 | 2.9 | 1.0 | 4 | 1 |
| | 45.0 | 45.0 | 10.0 | | 1.0 | | | | | |
| 17 | Ethyl acrylate | Methyl methacrylate | Itaconic anhydride | 'Nansa' 1106 1.4 | Potassium persulphate | 3.0 | not measured | 1.0 | 1 | 1 |
| | 43.6 | 45.9 | 10.5 | | 1.0 | | | | | |
| 18 | Ethyl acrylate | Methyl methacrylate | Itaconic anhydride | 'Nansa' 1106 1.4 | Potassium persulphate | 3.0 | not measured | 1.0 | 1 | 1 |
| | 38.6 | 52.1 | 9.3 | | 1.0 | | | | | |

TABLE 3

| Example | Comonomers and mole % in polymerisation mixture | | Emulsifying agent and amount - weight % based on total weight of comonomers | Catalyst and amount - weight % based on total weight of comonomers | pH | Amount of free acid, itaconate or anhydride in subbing composition - % by weight based on weight of copolymer | Dry coat weight of subbing layer mg/dm$^2$ | Dry adhesion | Wet adhesion |
|---|---|---|---|---|---|---|---|---|---|
| 19 | Ethyl acrylate | 45.0 | 'Nansa' 1106 1.5 | Potassium persulphate 1.0 | 3.6 | 2.2 | 0.75 | 1 | 1 |
| | Methyl methacrylate | 45.0 | | | | | | | |
| | Itaconic acid | 8.0 | | | | | | | |
| | Acrylamide | 2.0 | | | | | | | |

We claim:

1. A light-sensitive photographic film, which comprises a self-supporting plastics film, a copolymeric subbing layer applied to at least one surface of said film and a light-sensitive photographic emulsion layer bonded directly to the copolymeric subbing layer, said copolymeric subbing layer comprising a copolymer prepared from a comonomer mixture consisting essentially of 35 to 55 mole % acrylic acid or a lower alkyl ester thereof in which the alkyl group comprises up to 8 carbon atoms, 35 to 55 mole % methacrylic acid or a lower alkyl ester thereof in which the alkyl group comprises up to 8 carbon atoms, and 1 to 15 mole % of itaconic acid or itaconic anhydride and 0 to 8 mole % of additional monomer selected from the class consisting of acrylamide, methacrylamide, N-methylol acrylamide, N-ethanol acrylamide, N-propanol acrylamide, N-methylol methacrylamide, N-ethanol methacrylamide, N-methyl acrylamide, N-tertiary-butyl acrylamide, acrylonitrile, halo-substituted acrylonitrile, methacrylonitrile, and dimethylaminoethyl methacrylate, and said copolymeric subbing layer having a dry coat weight in the range 0.05 to 3.00 mg/dm$^2$ and being applied from an aqueous dispersion having a pH in the range 2.0 to 5.0.

2. A photographic film according to claim 1, in which the self-supporting plastics film comprises a biaxially oriented and heat-set film of polyethylene terephthalate.

3. A photographic film according to claim 1, in which the subbing copolymer is prepared from a comonomer mixture which includes ethyl acrylate and methyl methacrylate.

4. A photographic film according to claim 1, in which the subbing layer comprises at least 1.0% by weight based on the weight of the subbing copolymer of free itaconic acid, half ester of itaconic acid, or itaconic anhydride.

5. A photographic film according to claim 1, in which the subbing copolymer is prepared from a comonomer mixture which includes 42 to 50 mole % of acrylic acid or the lower alkyl ester thereof and 44 to 55 mole % of methacrylic acid or the lower alkyl ester thereof.

6. A photographic film according to claim 1, in which the subbing copolymer consists of 43 to 50 mole % ethyl acrylate, 45 to 53 mole % methyl methacrylate and 4 to 10 mole % of itaconic acid.

7. A photographic film according to claim 1, in which the dried coat weight of the subbing layer is 0.5 to 1.00 mg/dm$^2$.

8. A process for the production of a light-sensitive photographic film, which comprises coating at least one surface of a self-supporting plastics film with a subbing composition consisting essentially of an aqueous dispersion having a pH in the range 2.0 to 5.0 or a solution in an organic solvent of a copolymer prepared from a comonomer mixture comprising 35 to 55 mole % of acrylic acid or a lower alkyl ester thereof in which the alkyl group comprises up to 8 carbon atoms, 35 to 55 mole % methacrylic acid or a lower alkyl ester thereof in which the alkyl group comprises up to 8 carbon atoms, and 1 to 15 mole % of itaconic acid or itaconic anhydride and being applied from an aqueous dispersion having a pH in the range 2.0 to 5.0, and causing or allowing the coating to dry to a coat weight in the range 0.05 to 3.00 mg/dm$^2$, and applying a layer of a light-sensitive photographic emulsion directly onto the resulting copolymeric subbing layer.

9. A process according to claim 8, in which the self-supporting plastics film is biaxially oriented and the subbing composition is applied to the surface of the film between the two stretching operations employed to orient the film.

10. A process according to claim 8, in which the subbing composition has a pH in the range 2.5 to 3.0.

11. A process according to claim 8, in which the subbing composition includes 2 to 10% by weight of the subbing copolymer.

12. A process according to claim 8, in which the self-supporting plastics film comprises a biaxially oriented and heat-set film of polyethylene terephthalate.

13. A process according to claim 8, in which the subbing copolymer is prepared from a comonomer mixture which includes ethyl acrylate and methyl methacrylate.

14. A process according to claim 8, in which the subbing layer comprises at least 1.0% by weight based on the weight of the subbing copolymer of free itaconic acid or itaconic anhydride.

15. A process according to claim 8, in which the subbing copolymer is prepared from a comonomer mixture which includes 42 to 50 mole % of acrylic acid or the lower alkyl ester thereof and 44 to 55 mole % of methacrylic acid or the lower alkyl ester thereof.

16. A process according to claim 8, in which the subbing copolymer consists of 43 to 50 mole % ethyl acrylate, 45 to 53 mole % methyl methacrylate and 4 to 10 mole % of itaconic acid.

17. A process according to claim 8, in which the dried coat weight of the subbing layer is 0.5 to 1.00 mg/dm$^2$.

* * * * *